United States Patent [19]

Rind et al.

[11] Patent Number: 4,776,802

[45] Date of Patent: Oct. 11, 1988

[54] LEARNING AID AND PUZZLE

[76] Inventors: Shlomit Rind; Bruce Rind, both of 3136 Riverside Dr., Wellsville, N.Y. 14895

[21] Appl. No.: 40,913

[22] Filed: Apr. 21, 1987

Related U.S. Application Data

[63] Continuation-in-part of Ser. No. 937,770, Dec. 4, 1986, abandoned.

[51] Int. Cl.[4] ..... A63F 9/10; G09B 1/22

[52] U.S. Cl. ..... 434/345; 273/157 R; 434/404; 434/406

[58] Field of Search ..... 273/156, 157 R; 434/167, 170, 259, 304, 327, 404, 406, 345

[56] References Cited

U.S. PATENT DOCUMENTS

| | | | |
|---|---|---|---|
| 280,878 | 7/1883 | Stranders . | |
| 318,823 | 5/1885 | Stranders . | |
| 388,486 | 8/1888 | Hall . | |
| 723,425 | 3/1903 | Thompson . | |
| 889,515 | 6/1908 | Foley . | |
| 1,085,405 | 1/1914 | Dadd . | |
| 1,230,263 | 6/1917 | Alexander . | |
| 1,359,646 | 11/1920 | Zion . | |
| 1,439,359 | 12/1922 | Estes . | |
| 1,538,530 | 5/1925 | Troidl . | |
| 1,987,496 | 1/1935 | Springborn | 273/157 R |
| 2,066,871 | 1/1937 | Wolfe . | |
| 2,417,216 | 3/1947 | Sayre . | |
| 2,444,768 | 7/1948 | Eby . | |
| 2,474,447 | 6/1949 | Wheelock . | |
| 2,647,330 | 8/1953 | Ford | 273/157 RUX |
| 3,034,229 | 5/1962 | Kessler | 434/304 |
| 3,174,753 | 3/1965 | Miller | 273/157 RX |
| 3,235,976 | 2/1966 | Elliott et al. | 434/170 |
| 3,453,750 | 7/1969 | Rapaport | 273/157 RX |
| 3,665,618 | 5/1972 | Hahn . | |
| 3,673,712 | 7/1972 | Dacey et al. | 434/167 |
| 4,173,832 | 11/1979 | Chen et al. . | |
| 4,360,347 | 11/1982 | Ghaznavi | 273/157 R |
| 4,361,328 | 11/1982 | Stein et al. | 434/406 X |
| 4,437,667 | 3/1984 | Miller | 273/153 S |

OTHER PUBLICATIONS

Cleo Learning Aids Catalog, 1976, p. 116 434–348.

*Primary Examiner*—Anton O. Oechsle

*Attorney, Agent, or Firm*—Sprung Horn Kramer & Woods

[57] ABSTRACT

A learning aid comprising a. a disk having a plurality of sectors, each of the sectors having a descriptive matter section adjacent the periphery of the disk, the descriptive matter section occupying a portion of each of the sectors, b. a plurality of removable puzzle pieces for each of the sectors, each of the puzzle pieces being able to occupy a portion of its corresponding sector, each of the puzzle pieces being of a different shape from one another, each of the puzzle pieces having an identifying word, letter or number associated therewith which describes the descriptive matter. The learning aid is particularly useful is teaching young children how to read.

13 Claims, 3 Drawing Sheets

LEARNING AID AND PUZZLE

CROSS-REFERENCE TO RELATED APPLICATION

This patent application is a continuation-in-part application of application Ser. No. 937,770, filed Dec. 4, 1986, now abandoned.

BACKGROUND OF THE INVENTION

1. Field of the Invention

The present invention concerns a learning aid in the form of a puzzle.

2. Background Information

There are presently common "jigsaw" puzzles in the marketplace wherein a young child is amused by completing a picture by fitting together various different puzzle pieces by virtue of only their different shapes.

It would be advantageous if while the child is amusing himself or herself in playing with a puzzle that at the same time the child performs a mental exercise and is thus taught a subject.

SUMMARY OF THE INVENTION

It is an object of the present invention to provide a puzzle wherein a child has to perform a mental exercise in order to ascertain where the different pieces of the puzzle fit.

This and other objects and advantages are accomplished by the present invention which concerns a learning aid comprising a. a disk having a plurality of sectors, each of the sectors having a descriptive matter section adjacent the periphery of the disk, said descriptive matter section occupying a portion of each of the sectors, b. a plurality of removable puzzle pieces for each of the sectors, each of the puzzle pieces being able to occupy a portion of its corresponding sector, each of the puzzle pieces being of a different shape from one another, each of the puzzle pieces having an identifying word, letter or number associated therewith which describes the descriptive matter.

DETAILED DESCRIPTION OF THE INVENTION

Figure 1:
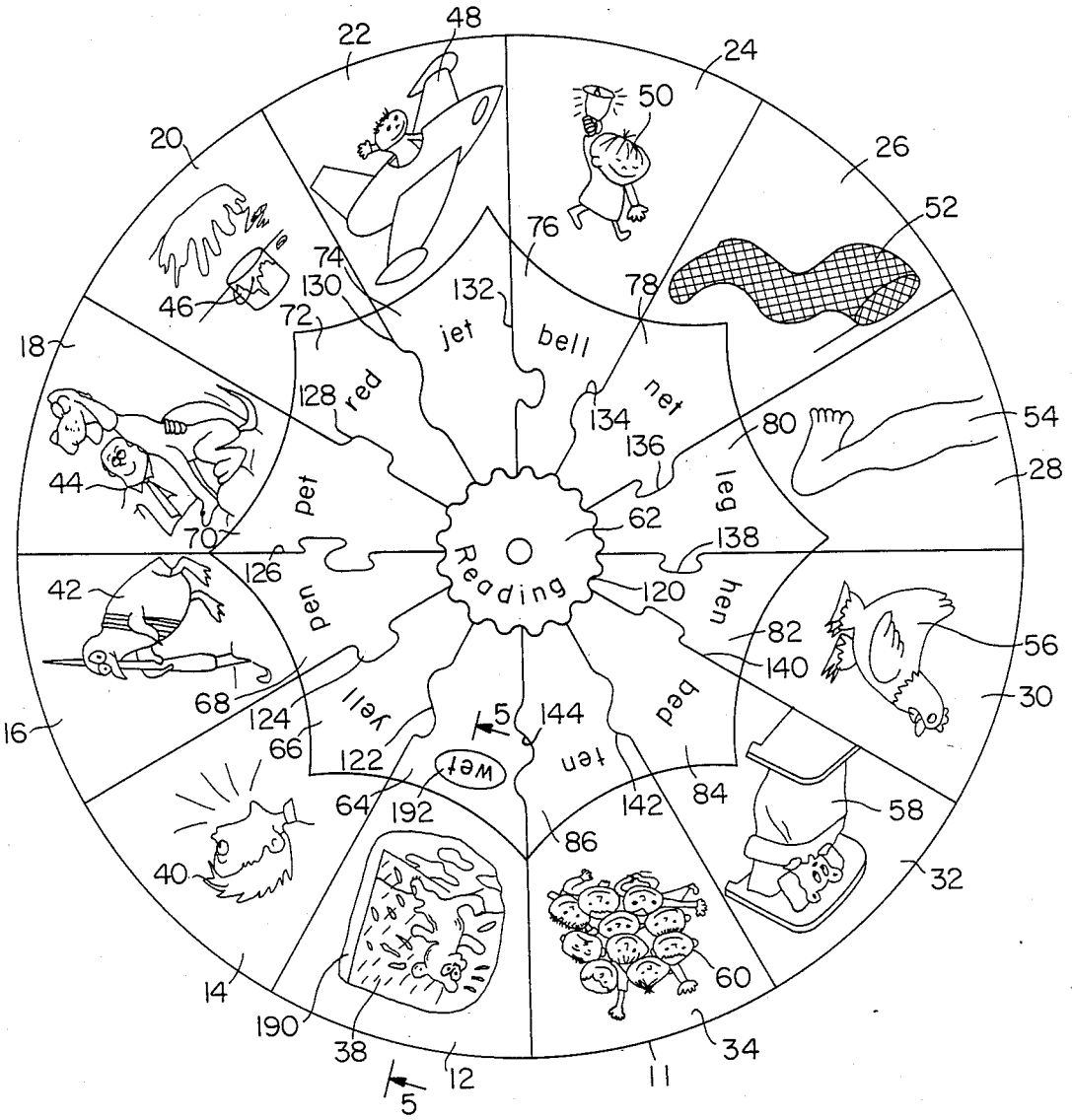
FIG. 1 is a plan view of a disk for use in the learning aid in accordance with the present invention.

Referring to the drawings, in all of which like parts are designated by like reference numerals, there is depicted in FIG. 1 a puzzle learning aid 10 in accordance with the present invention. Puzzle learning aid 10 contains a disk 11 divided into twelve (12) sectors 12, 14, 16, 18, 20, 22, 24, 26, 28, 30, 32, and 34, respectively, of equal circumference.

Each of the sectors has a descriptive matter section adjacent the periphery of the disk. Sector 12 has a section 38 showing a picture of a dog running through rain inscribed thereon. Alternatively the picture of the dog can be inscribed on a removable, relatively thin plastic, piece that can be precolored or colorable by pencil, pen, ink, paint, crayon, etc. Hereinbelow, whenever the term inscribed in used, it is to be understood that in place thereof the aforementioned plastic pieces can be utilized. To accept such plastic piece the section may have to have a plastic laminate to allow the plastic piece to adhere by friction to the section. Sector 14 has a section 40 with a picture of a boy yelling inscribed thereon. Sector 16 has a section 42 with a picture of a bird holding a pen inscribed thereon.Sector 18 has section 44 with a picture of a man embracing a dog inscribed thereon. Sector 20 has a section 46 with a picture of a paint can with paint splashing out of the can inscribed thereon. Sector 22 has a section 48 with a picture of a boy in an airplane inscribed thereon. Sector 24 has a section 50 with a picture of a boy ringing a bell inscribed thereon. Sector 26 has a section 52 with a picture of a net inscribed thereon. Sector 28 has a section 54 with a picture of a leg inscribed thereon. Sector 30 has a section 56 with a picture of a hen inscribed thereon. Sector 32 has section 58 with a picture of a dog in a bed inscribed thereon. Sector 34 has a section 60 with a picture of ten children inscribed thereon.

In the center of the disk 11 is a circular section 62 having a hole through the center thereof through which a post (not shown in FIG. 1) can be disposed. The circular section 62 preferably has an irregularly shaped circumference 120, i.e., in the shape of a saw tooth or a wavy shaped. The disk 11 is rotatable, i.e., able to spin and pivot around the post, thus allowing the words and pictures on the disk 11 to be read right-side up.

Within sector 12 and disposed between circular section 62 and section 38 is removable puzzle piece 64 with the word "wet" inscribed thereon. As described hereinabove, the term "wet" and other terms can be inscribed directly on the puzzle piece or the term "wet" can be inscribed on a relatively thin plastic piece that is removable and which can adhere by friction to the puzzle piece, to accept such plastic piece on the sector. The secctor may have to contain a plastic laminate to allow the plastic piece to adhere by friction to the sector.

Within sector 14 and disposed between circular section 62 and section 40 is a removable puzzle piece 66 with the word "yell" inscribed thereon. Within sector 16 and disposed between circular section 62 and section 42 is a removable puzzle piece 68 with the word "pen" inscribed thereon.

Within sector 18 and disposed between circular section 62 and section 44 is a removable puzzle piece 70 with the word "pet" inscribed thereon.

Within sector 20 and disposed between circular section 62 and section 46 is a removable puzzle piece 72 with the word "red" inscribed thereon.

Within sector 22 and disposed between circular section 62 and section 48 is a removable puzzle piece 74 with the word "jet" inscribed thereon.

Within sector 24 and disposed between circular section 62 and section 50 is a removable puzzle piece 76 with the word "bell" inscribed thereon.

Within secctor 26 and disposed between circular section 62 and section 52 is a removable puzzle piece 78 with the word "net" inscribed thereon.

Within sector 28 and disposed between circular section 62 and section 54 is a removable puzzle piece 80 with the word "leg" inscribed thereon.

Within sector 30 and disposed between circular section 62 and section 56 is a removable puzzle piece 82 with the word "hen" inscribed thereon.

Within sector 32 and disposed between circular section 62 and section 58 is a removable puzzle piece 84 with the word "bed" inscribed thereon.

Within sector 34 and disposed between circular section 62 and section 60 is a removable puzzle piece 86 with the word "ten" inscribed thereon.

By using removable plastic pieces as described above, the child using the present invention can in effect create his own puzzle.

Each of the puzzle pieces 64, 66, 68, 70, 72, 74, 76, 78, 80, 82 84 and 86 are shaped differently from each other at the periphery of each puzzle piece where the puzzle piece is adjacent to its corresponding descriptive section.

The sides of the puzzle pieces can be straight, It is preferred, however, that one of more of such sides, namely, 122, 124, 126, 128, 130, 132, 134, 136, 138, 140, 142 and 144 are irregularly shaped so that the side of adjoining puzzle pieces for example, side 138 which borders on pieces 80 and 82, is in a "jig-saw puzzle" shape.

The pictures inscribed in each of the sections can be in black and white or can be colored. It is preferred that such pictures be colored, especially when words describing colors (e.g., red) are utilized.

Figure 5:
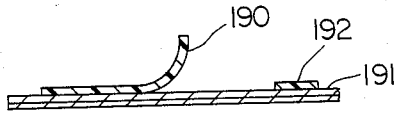
FIG. 5 is a sectional view taken along line 5—5 of FIG. 1.

In FIG. 5 there is depicted the embodiment of the invention wherein the aforesaid removable plastic pieces are utilized. Removable plastic piece 190 with a picture of a dog running in the rain is disposed on laminated surface 191 of the disk 11. Removable plastic piece 192 with the term "wet" inscribed thereon is also disposed on laminated surface 191.

It is preferred that the disk 11 itself be colored, e.g., in a bright orange color.

Although one type of disk 11 is depicted in FIG. 1, other types of disks can be employed.

Other disks that can be utilzied include, for example, disks to teach the capital letters, its diminished letters and their sounds; disks to teach numbers, and disks to teach colors. The disk depicted in FIG. 1 is designed for children who can sound out the letters of the alphabet, and who are ready to take their first steps in reading. When using such disk, the child has to read the word ("wet", for example) and then put the puzzle piece under the picture that described the word - thus getting feedback for the child's reading. Each puzzle piece, with the word inscribed thereon can fit only adjacent to its matching picture so that the child will make no errors.

Figure 2:
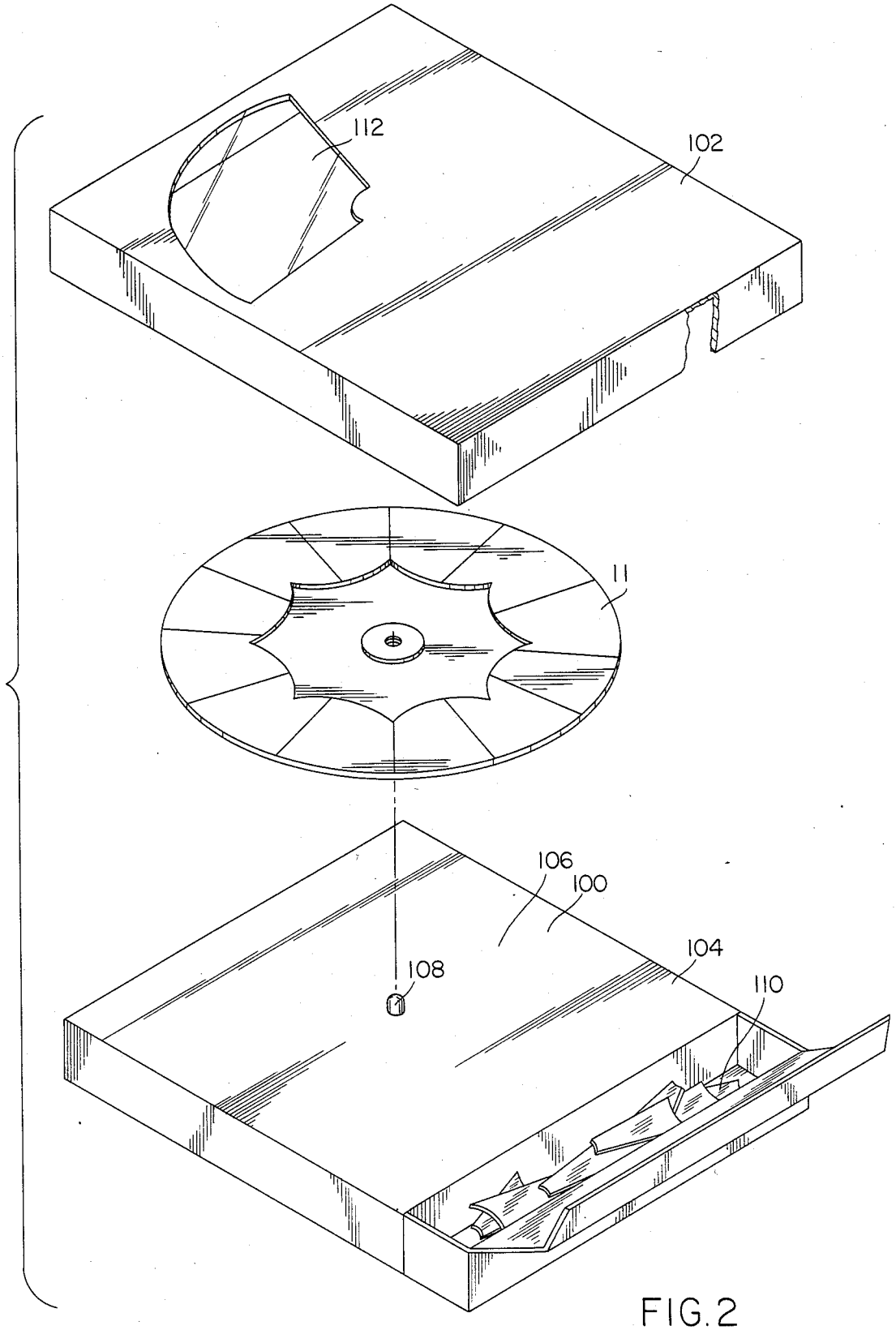
FIG. 2 is an exploded perspective view of the learning aid and box for housing the same in accordance with the present invention.

FIG. 2 depicts a box 100 having a cover 102 and a base portion 104. Disk 11 is disposed on the top surface 106 of base portion 104 through post 108. Base portion 104 has a compartment 10 for housing the puzzle pieces. Base portion 104 has a compartment 114 for housing a plurality of disks. Cover 102 has a see-through plastic window 121 wherein a portion of the disk 11 can be viewed from outside the box 100 (see FIG. 4).

Figure 3:
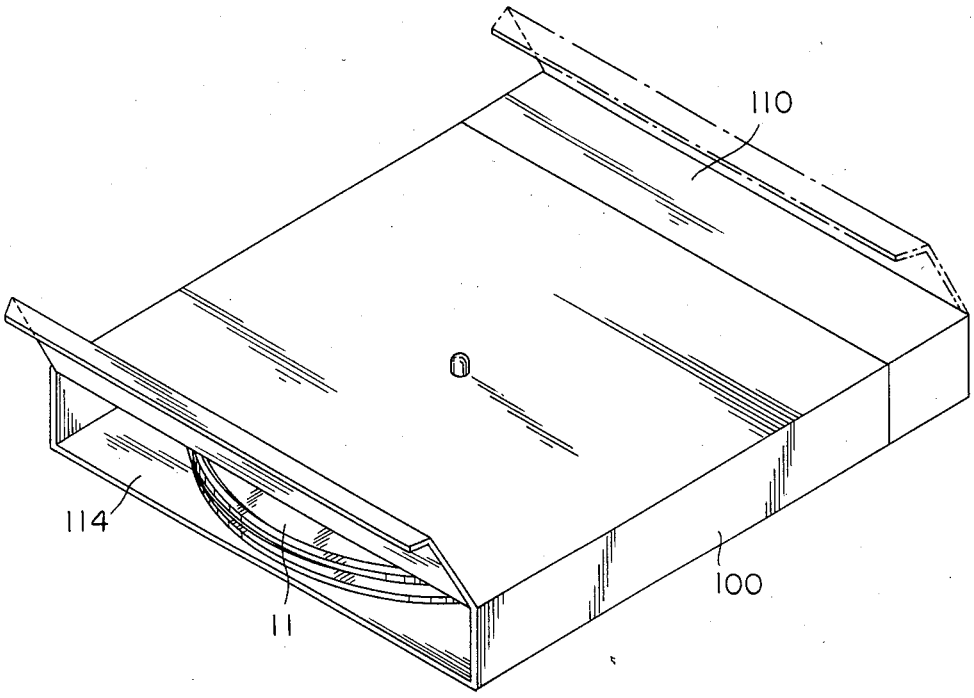
FIG. 3 is a perspective view of the box depicted in FIG. 2.

FIG. 3 depicts the box 100 as shown in FIG. 2 and also shows compartment 114 at the side end of box 100 for storing disks 111.

Figure 4:
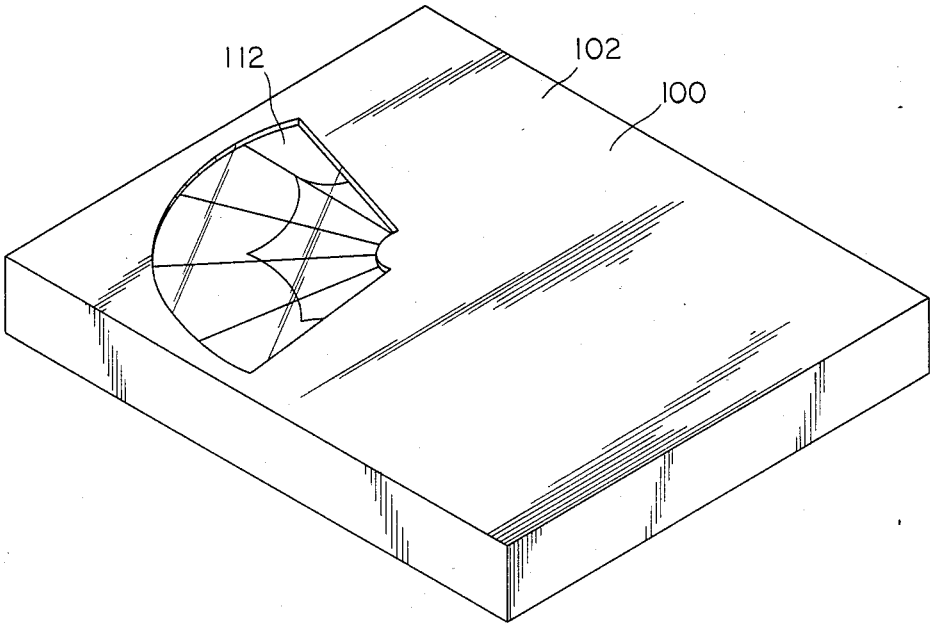
FIG. 4 is a perspective view of the box with the box cover as depicted in FIG. 2, wherein the box cover is in place over the box base.

FIG. 4 shows the box 100 as shown in FIG. 2, but where the box cover 102 covers the box base portion 104 (not shown in FIG. 4) so as to shown part of the disk 11 through the window 112.

It will be appreciated that the instant specification and claims are set forth by way of illustration and not limitation, and that various modifications and changes may be made without departing from the spirit and scope of the present invention.

What is claimed is:

1. A learning aid comprising a. a disk having a plurality of sectors, each of said sectors having a descriptive matter section adjacent the periphery of said disk, said descriptive matter section occupying a portion of each of said sectors, b. a plurality of removable puzzle pieces for each of said sectors, each of said puzzle pieces being able to occupy a portion of its corresponding sector inwardly of said descriptive matter section and in abutting relationship to a descriptive matter section, each of said puzzle pieces being of a different shape from one another with the edges of adjacent puzzle pieces being complemental to each other, each of said puzzle pieces having an identifying word, letter or number associated therewith which describes said descriptive matter, wherein the periphery of each puzzle piece that is adjacent each said descriptive matter section is different in shape and complemental to the edge of the descriptive matter section against which it abuts.

2. A learning aid according to claim 1, wherein the descriptive matter on the sector is inscribed on a removable, relatively thin plastic piece.

3. A learning aid according to claim 1, wherein the identifying word, letter or number on the puzzle piece is inscribed on a removable, relatively thin plastic piece.

4. A learning aid according to claim 1, which further comprises a box and box cover to house said disk.

5. A learning aid according to claim 4, wherein said box has a top surface to support said disk.

6. A learning aid according to claim 5, wherein said disk is rotatably mounted on said top surface of said box.

7. A learning aid according to claim 5, wherein said box further comprises a compartment for housing said puzzle pieces.

8. A learning aid according to claim 1, wherein each of said descriptive matter sections comprises a picture inscribed therein.

9. A learning aid according to claim 1, wherein each of said puzzle pieces comprises a word inscribed thereon.

10. A learning aid according to claim 1, wherein there are twelve sectors of equal circumference.

11. A learning aid according to claim 1, which further comprises a circular section disposed at the center of said disk, said puzzle pieces being disposed adjacent the periphery of said circular section.

12. A learning aid according to claim 11, wherein the circular section has an irregular circumference.

13. A learning aid according to claim 1, wherein in the center of the disk is a hole and a post is inserted in said hole for rotation of the disk around said post.

* * * * *

UNITED STATES PATENT AND TRADEMARK OFFICE

CERTIFICATE OF CORRECTION

PATENT NO. : 4,776,802

DATED : Oct. 11, 1988

INVENTOR(S) : Rind et al.

It is certified that error appears in the above-identified patent and that said Letters Patent is hereby corrected as shown below:

| | |
|---|---|
| Col. 2, line 6 | Delete "in" in first instance and substitute --is-- |
| Col. 2, line 45 | Correct spelling of --sector-- |
| Col. 3, line 23 | Delete "of" in first instance and substitute --or-- |
| Col. 3, line 64 | Delete "10" and substitute --110-- |
| Col. 3, line 67 | Delete "121" and substitute --112-- |
| Col. 4, line 6 | "shown", second occurrence to read -- show --. |

Signed and Sealed this

Twenty-sixth Day of September, 1989

*Attest:*

*Attesting Officer*

DONALD J. QUIGG

*Commissioner of Patents and Trademarks*